United States Patent [19]

Marchand

[11] 4,049,009

[45] Sept. 20, 1977

[54] APPARATUS FOR TRIMMING THE NAILS

[76] Inventor: Florian Marchand, Rue la Golatte 1, 2738 Court, Berne, Switzerland

[21] Appl. No.: 353,412

[22] Filed: Apr. 23, 1973

[30] Foreign Application Priority Data

Apr. 27, 1972 Switzerland ..... 6285/72

[51] Int. Cl.[2] ..... A45D 29/04

[52] U.S. Cl. ..... 132/76.4

[58] Field of Search ..... 132/76.4, 76.5, 73, 132/73.5, 73.6, 75.8, 75.3; 64/4; 128/304, 153; 51/309

[56] References Cited

U.S. PATENT DOCUMENTS 2,008,920 7/1935 Moir ..... 64/4

*Primary Examiner*—G. E. McNeill

*Attorney, Agent, or Firm*—Stevens, Davis, Miller & Mosher

[57] ABSTRACT

The flexible wire connecting the electric motor enclosed in casing 1 to the grinding-wheel 17 can be neatly stored without disconnecting it from its driving shaft, merely by winding it around casing 1 while fitting its protecting sheath 18 tightly into grooves 20 and 21 of the casing, thus forming a loop 22 constituting a handle which permits the apparatus to be hung on a hook when it is not in use.

4 Claims, 3 Drawing Figures

APPARATUS FOR TRIMMING THE NAILS

BACKGROUND OF THE INVENTION

1. Field of the Invention

This invention relates to apparatus for trimming the nails and in particular to apparatus which comprise a casing, an electric motor in said casing, a socket, a grinding-wheel mounted for rotary motion in said socket, a flexible wire connecting said motor to said grinding-wheel for driving the same and a sheath surrounding said wire, said sheath having one end secured to said casing and the other end connected to said socket.

2. Description of the prior art

The known apparatus of this type have the advantage that they are easy to handle, because the socket carrying the grinding-wheel is neither bulky nor heavy and is connected to the motor casing by flexible means. These known apparatus have, however, some drawbacks, especially when they have to be put away.

The motor casing of these known apparatus is usually made with an annular partition case surrounding the motor and in which the flexible wire can be neatly stored when the apparatus is not in use. For that purpose, the flexible wire must, however, be disconnected from its driving shaft. Every time the apparatus is to be used, the flexible wire thus has to be pulled out of its partition case and to be connected to its driving shaft; then, after use, it must be disconnected from that shaft and introduced again into its partition case. If a hurried user of the apparatus omits these procedures and leaves the flexible wire in working position, he may expose his apparatus to some damage. Either the flexible wire or the socket carrying the grinding-wheel can be caught in some part of another object put away at the same place as the apparatus. When removing such an object the apparatus can be inadvertently moved and its casing caused to fall down and possibly to break. In addition to the precautionary measures which the known apparatus require, the partition case provided for neatly storing the flexible wire obviously increases the sizes of the apparatus, thus it renders the same more bulky and also more expensive while rendering its manufacture more intricate.

SUMMARY OF THE INVENTION

It is therefore an object of the invention to provide an apparatus of the type indicated above, which enables neatly storing the flexible wire while leaving the same connected to its driving shaft.

A more particular object of the invention consists in providing the outer surface of the motor casing with grooves, said grooves having sizes adapted to said sheath in order to enable tightly fitting said sheath into said grooves upon winding said sheath and said wire around said casing without disconnecting said wire from its driving shaft.

Still another even more particular object of the invention consists in providing said grooves in opposed side walls of the motor casing so that said sheath and said wire will form a loop beyond a rear wall of the casing upon winding said wire and said sheath around the casing while fitting the sheath into the grooves, these grooves being narrow enough with respect to the sheath to produce a strong fitting thereof, ensuring that the loop will constitute a handle permitting the apparatus to be hung thereby.

Still further objects of the invention will appear in the course of the following description.

BRIEF DESCRIPTION OF THE DRAWINGS

One embodiment of the apparatus according to the invention is represented diagrammatically and by way of example in the accompanying drawings.

In the drawings.

DESCRIPTION OF THE PREFERRED EMBODIMENT

Figure 1:
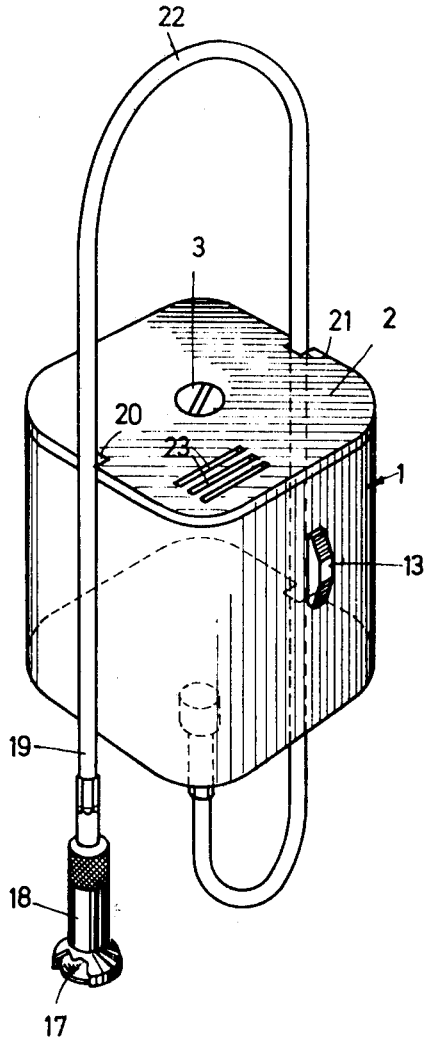
FIG. 1 is a perspective view of that embodiment.

The apparatus represented in the drawings comprises a casing 1 which is closed by a cover member 2 constituting the rear wall of the casing. Cover member 2 is secured to casing 1 by means of a screw 3 engaging a pillar 4 fixed to the front wall 5 of casing 1.

Figure 2:
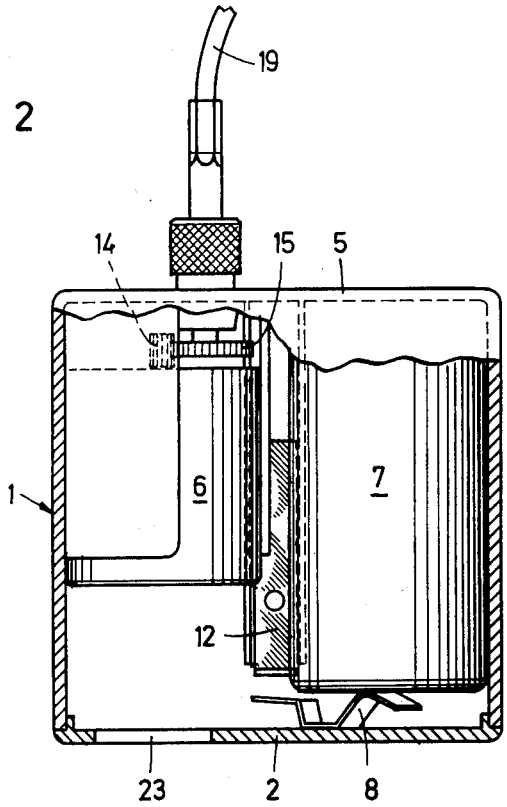
FIG. 2 is a sectional view of a part of the apparatus along line II—II of FIG. 3.
Figure 3:
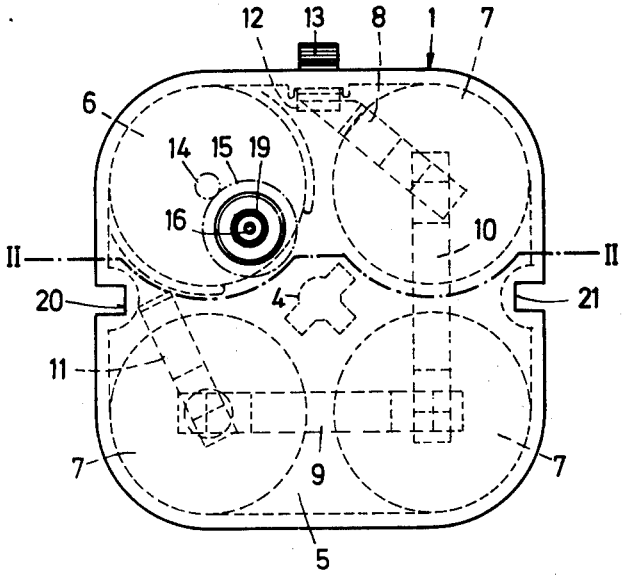
FIG. 3 is a plan view of the part represented in FIG. 2.

Casing 1 has substantially the shape of a cube, the side edges of which are however rounded. A DC motor 6 having a substantially cylindrical shape and a diameter somewhat smaller than half the length of an edge of casing 1, is mounted in the latter in the vicinity of one of its side edges. Three electric batteries 7 of common type having a diameter substantially equal to that of motor 6 are also mounted in casing 1, each one in the vicinity of one of the three remaining side edges of this casing. Two clips 8 and 9 carried by cover member 2 and two further clips 10 and 11 secured to the front wall 5 of casing 1 ensure connecting batteries 7 in series in a circuit comprising motor 6 and a switch having a contact strip 12 which can be moved up and down in FIG. 2 by means of a knob 13 fixed to that strip and protruding from one side wall of casing 1.

The arbor (not shown) of motor 6 carries a pinion 14 meshing with a driving gear 15 having a shaft to which the end of a flexible wire 16 is removably connected. The other end of wire 16 is connected to a conventional grinding-wheel 17 which is mounted for rotary motion in a socket 18. A sheath 19 having one end secured to socket 18 and the other end secured to casing 1 surrounds wire 16 and protects it.

The three batteries 7, which are connected in series, provide a satisfactory supply for DC motor 6 which is thus strong enough to overcome the friction of wire 16 within sheath 19 and to drive wheel 17 satisfactorily.

Two grooves 20 and 21 are provided in two opposed side walls of casing 1. The sizes of grooves 20, 21 are adapted to those of sheath 19 in such a manner that the latter can be tightly fitted in said grooves as shown in FIG. 1.

Grooves 20, 21 thus have the advantage of permitting the wire to be neatly stored without disconnecting it from the shaft of gear 15 which drives it. These grooves have the further advantage to enable forming a loop 22 (FIG. 1) with the wire and its sheath, this loop constituting a handle by means of which the apparatus can be hung on a hook, for instance.

Instead of fitting the part of sheath 19 adjacent to the front wall 5 of casing 1 firstly into groove 21, as shown in FIG. 1, it could also be fitted firstly into groove 20, which is nearer to the shaft of the driving gear 15. The loop which the sheath then forms beyond wall 5 of the casing 1 may have so small a radius of curvature that the friction of wire 16 within sheath 19 prevents grinding-wheel 17 from rotating, even if switch (12, 13) is on. The flexible wire will preferably be neatly stored in that way when the apparatus has to be carried with other objects, for instance in a briefcase or a bag.

Slots 23 are provided in cover member 2 for ventilating casing 1.

What I claim is:

1. An apparatus for trimming the nails, comprising a casing, an electric motor in said casing, a rotary shaft in said casing driven by said motor, a socket, a grinding-wheel mounted for rotary motion in said socket, a flexible wire connecting said rotary shaft to said grinding-wheel for driving said wheel together with said shaft, a sheath surrounding said wire, said sheath having one end secured to said casing and the other end connected to said socket, and grooves provided in the outer surface of said casing, said grooves having sizes adapted to said sheath in order to enable tightly fitting said sheath into said grroves upon winding said sheath and said wire around said casing without disconnecting said wire from said shaft, said casing having a front wall to which said sheath is connected, two opposed side walls on either side of said motor and being substantially parallel to the motor axis, and a rear wall, said grooves being provided in said opposed side walls in order that said sheath and said wire form a loop beyond said rear wall upon winding them around said casing, and said sheath being fitted in said grooves strongly enough in order that said loop constitutes a handle permitting the apparatus to be hung thereby.

2. An apparatus according to claim 1, further comprising electric batteries, said motor being a DC motor supplied by said batteries, said batteries being located in said casing.

3. An apparatus for trimming the nails, comprising a casing, an electric motor in said casing, a rotary shaft in said casing driven by said motor, a socket, a grinding-wheel mounted for rotary motion in said socket, a flexible wire connecting said rotary shaft to said grinding-wheel for driving said wheel together with said shaft, a sheath surrounding said wire, said sheath having one end secured to said casing and the other end connected to said socket, and grooves provided in the outer surface of said casing, said grooves having sizes adapted to said sheath in order to enable tightly fitting said sheath into said grooves upon winding said sheath and said wire around said casing without disconnecting said wire from said shaft, said sheath and said wire, when wound around said casing, forming a loop having a sufficiently small radius of curvature to prevent said grinding-wheel from rotating.

4. An apparatus according to claim 3 comprising two grooves, each said groove being formed on the outer surface of said casing on opposite sides thereof, one of said grooves being nearer to said shaft, and in which said sheath is fitted firstly into said one groove and then into the other groove.

* * * * *